US006466172B1

(12) United States Patent
Ryken et al.

(10) Patent No.: US 6,466,172 B1
(45) Date of Patent: Oct. 15, 2002

(54) GPS AND TELEMETRY ANTENNA FOR USE ON PROJECTILES

(75) Inventors: Marvin L. Ryken, Ventura, CA (US); Albert F. Davis, Ventura, CA (US); Scott R. Kujiraoka, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/039,939

(22) Filed: Oct. 19, 2001

(51) Int. Cl.[7] ..... H01Q 1/36

(52) U.S. Cl. ..... 343/700 MS; 343/846; 343/853

(58) Field of Search ..... 343/700 MS, 705, 343/829, 846, 864, 853, 893; 333/134, 202; 342/375

(56) References Cited

U.S. PATENT DOCUMENTS 4,074,270 A * 2/1978 Kaloi ..... 343/700 MS
4,356,492 A 10/1982 Kaloi ..... 343/700 MS
5,019,829 A * 5/1991 Heckman et al. ..... 174/52.3
6,011,518 A * 1/2000 Yamagishi et al. .. 343/700 MS
6,272,349 B1 * 8/2001 McGrath et al. ..... 455/345

OTHER PUBLICATIONS

Design of a GPS/Telemetry Antenna For Small Diameter Projectiles Dr. Marv Ryken et al. Oct. 23, 2000. ITC/USA 2000. International Telemetry Conference. (No page number).

* cited by examiner

*Primary Examiner*—Tan Ho
(74) *Attorney, Agent, or Firm*—David Kalmbaugh

(57) ABSTRACT

A microstrip antenna system having a GPS antenna for receiving GPS data and a telemetry antenna for transmitting telemetry data mounted on a dielectric substrate. The microstrip antenna system is designed for use on small diameter airborne projectiles which have a diameter of about 2.75 inches. A filter is integrated into the antenna system to isolate the transmitted telemetry signal from the received GPS signal.

20 Claims, 6 Drawing Sheets

GPS AND TELEMETRY ANTENNA FOR USE ON PROJECTILES

BACKGROUND OF THE INVENTION

1. Field of the Invention

The present invention relates generally to an antenna for use on a missile or the like. More specifically, the present invention relates to a microstrip antenna which includes a GPS antenna for receiving GPS data and a telemetry antenna for transmitting telemetry data and which is adapted for use on small diameter device such as a missile.

2. Description of the Prior Art

In the past military aircraft and weapons systems such as airplanes, target drones, pods and missiles have included flight termination and beacon tracking antenna to monitor performance during test flights. For example, a missile under test will always have an antenna which is generally surface mounted to transmit telemetry data to a ground station. The ground station then performs an analysis of the telemetry data from the missile to determine its performance during flight while tracking a target.

U.S. Pat. No. 4,356,492 is an example of a prior art microstrip antenna which is adapted for use on a missile as a wrap around band to a missile body without interfering with the aerodynamic design of the missile. U.S. Pat. No. 4,356,492 teaches a plurality of separate radiating elements which operate at widely separated frequencies from a single common input point. The common input point is fed at all the desired frequencies from a single transmission feed line.

With the emerging use of the Global Positioning System (GPS) for tracking purposes, there is a need to include GPS within the instrumentation package for a missile and target drone to accurately measure flight performance. GPS data is extremely accurate and thus allows for a thorough analysis of the missile's performance as well as the target drone's performance in flight while the missile tracks the target drone on a course to intercept the target drone.

The use of satellite provided GPS data to monitor the position of a missile and a drone target in flight will require that an antenna for receiving the GPS data be included in the instrumentation package. The receiving antenna should preferably be mounted on the same dielectric substrate as the transmitting antenna so that the antenna assembly can be applied readily as a wrap around band to the missile body without interfering with the aerodynamic design of the missile. Similarly, the antenna assembly which would include a GPS data receiving antenna and telemetry data transmitting antenna a wrap around band to the target drone's body without interfering with the aerodynamic design of the target drone.

SUMMARY OF THE INVENTION

The present invention overcomes some of the disadvantages of the past including those mentioned above in that it comprises a relatively simple in design yet highly effective and efficient microstrip antenna assembly which can receive satellite provided GPS position and also transmit telemetry data.

The antenna assembly of the present invention includes a first microstrip antenna which is a telemetry antenna is mounted on a dielectric substrate. The telemetry antenna transmits telemetry data to ground station or other receiving station. There is also a second microstrip antenna mounted on the dielectric substrate which is physically separated from the first microstrip antenna on the dielectric substrate.

The second microstrip antenna is a GPS antenna adapted to receive satellite provided GPS position data. The antenna assembly is a wrap around antenna assembly which fits on the outer surface of a missile, target drone or any other small diameter projectile.

The telemetry antenna includes a pair of radiating elements with one radiating element being positioned on one side of the projectile and the other element being positioned on the opposite side of the projectile. One of the two radiating elements of the telemetry antenna has a feed line which provides for a 180 degree phase shift of the transmitted RF signal relative to the feed line for the other radiating element. This phase shift insures that the electric field for the transmitted RF signal is continuous around the circumference of the projectile.

The GPS antenna also has a pair of microstrip receiving antenna elements which are circularly polarized. Due to the close proximity of the telemetry and GPS antennas a band stop filter is integrated into the GPS antenna. The band stop filter has a minimum stop-band rejection of 40 decibels to prevent the telemetry data signal from saturating the GPS antenna.

DETAILED DESCRIPTION OF THE PREFERRED EMBODIMENT

Figure 1:
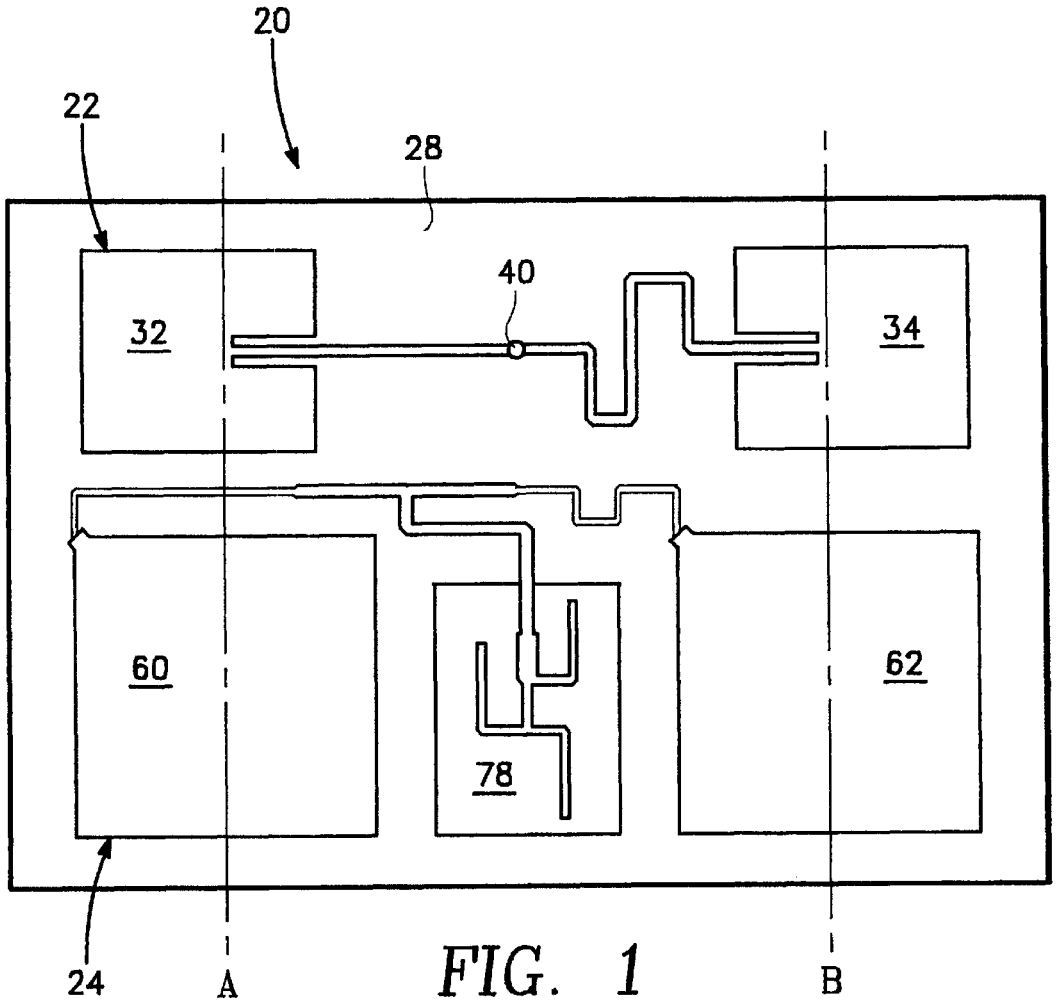
FIG. 1 is a plan view of a preferred embodiment of the invention showing a GPS and telemetry antenna mounted on a dielectric substrate.
Figure 2:
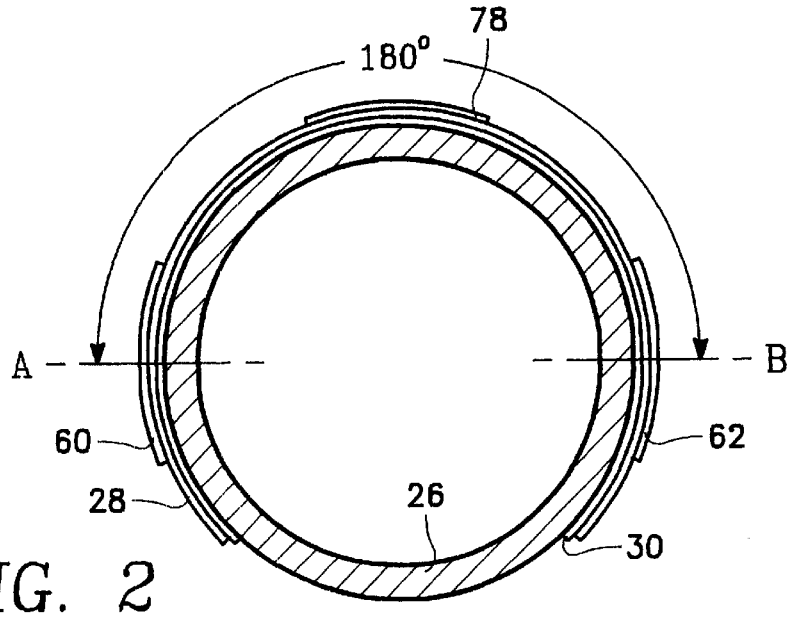
FIG. 2 is a sectional view of the antenna of FIG. 1 taken along plane A–B.

Referring first to FIGS. 1, 2, 3 and 4, there is shown an antenna assembly 20 comprising a telemetry antenna 22 and a GPS (Global Positioning System) antenna 24 for use on small diameter projectiles such as missiles and target drones. The diameter of the projectile 26 for which antenna assembly 20 is designed is approximately 2.75 inches.

The telemetry antenna 22 and GPS antenna 24 are separated physically and are mounted on a dielectric substrate 28. Positioned below dielectric substrate 28 is a ground plane 30. Dielectric substrate 28 is fabricated from a laminate material RT/Duroid 6002 commercially available from Rogers Corporation of Rogers Conn. This material allows sufficient strength and physical and electrical stability to satisfy environmental requirements and is also easily mounted on the surface of a missile or a target drone. The dielectric substrate 28 is fabricated from two layers of 0.031 inch thick material, and a 0.010 inch thick antenna protective cover board. The use of the multi-layer fabrication to fabricate the substrate is to prevent wrinkling and cracking of the substrate.

Figure 3:
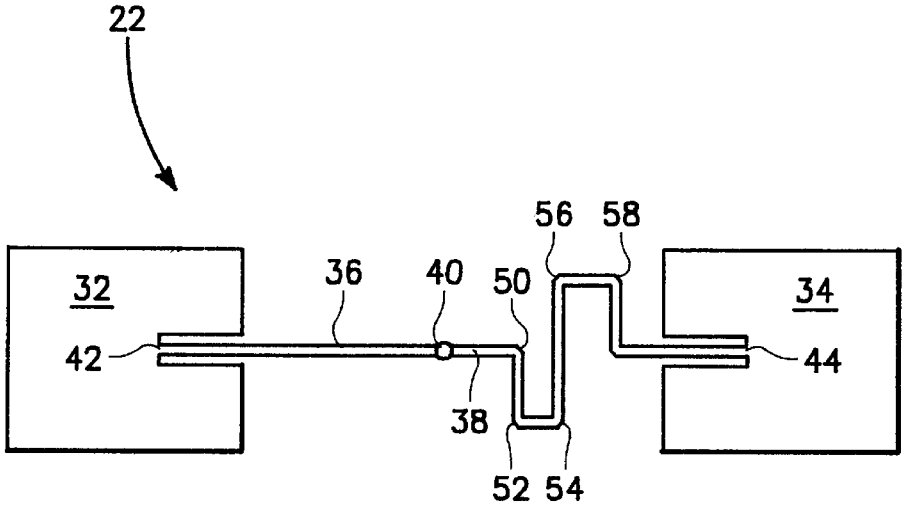
FIG. 3 is a schematic diagram illustrating the telemetry antenna of FIG. 1.

The telemetry antenna 22 comprises two separate microstrip radiating elements/antenna transmitting elements 32 and 34 respectively fed by microstrip feed lines 36 and 38 from a single feed input point 40 as shown in FIG. 3. The radiating elements 32 and 34 each have a shape which is rectangular and are notch fed. The element feed point 42 for radiating element 32 comprises a 100 ohm input and the element feed point 44 for radiating element 34 also comprises a 100 ohm input. The single feed input point 40 for both radiating elements 32 and 34 comprises a 50 ohm feed input. Paralleling the feed lines 36 and 38 which are 100 ohm transmission lines produces the input impedance of 50 ohms.

Telemetry antenna 22 has the following electrical characteristics: (1) a center frequency of 2250 MHz which is an S-Band Radio Frequency; (2) a bandwidth of ±10 MHz (3) a linear polarization; and (4) a roll coverage of −3 db +/−5 db.

The electric field generated by the RF signal transmitted by radiating elements 32 and 34 of telemetry antenna 22 needs to be continuous around the circumference of projectile 26. This, in turn, necessitates that one of the microstrip feed lines 36 or 38 provide for a 180 degree phase shift relative to the other feed line over the 2.24 to 2.26 operating frequency range for telemetry antenna 22.

The 180 degree phase shift is provided by microstrip feed line 38 which includes ninety degree angular bends/right angle bends 50, 52, 54, 56 and 58 to extend the length of feed line 38 which allows for the 180 degree phase shift.

The GPS receiving antenna 24 is also mounted on the dielectric substrate 28 in proximity to the telemetry antenna 22. The GPS receiving antenna 24 comprises two separate microstrip antenna receiving elements 60 and 62 which respectively have corner. feed points 64 and 66 a shown in FIG. 4. Since antenna receiving elements 60 and 62 are required to be circularly polarized, one side 68 of each element 60 and 62 is slightly longer than the other side 70 of each element 60 and 62 and the feed points 64 and 66 are positioned in the corner of the microstrip antenna receiving elements.

Receiving elements 60 and 62 are rectangular in shape and approximate a square. The difference in length between sides 68 and 70 of receiving elements 60 and 62 is in the order of one twenty thousandth of an inch.

GPS antenna 24 has the following electrical characteristics: (1) a center frequency of 1572.5 MHz which is an L-Band Radio Frequency (GPS Band L1); (2) a bandwidth of ±10 MHz (3) a circular polarization; and (4) a roll coverage of −3 db +/−5 db.

The input impedance at the feed input 64 for antenna element 60 and the feed input 66 for antenna element 62 is approximately 250 ohms and is matched to the 50 ohm common feed point 72 through approximately quarter wavelength impedance transformers 74 and 76. Transformer 76 includes an indented portion 77 which insures that its length is equal to the length of transformer 74.

GdPS antenna also has a T shaped microstrip transmission line 79 which connects the quarter wavelength impedance transformers 74 and 76 to a band stop filter 78. T shaped microstrip transmission line 79 has a pair of 70 ohm arms and a 35 ohm trunk line with two right angle bends connected to filter 78.

The GPS antenna 24 includes band stop filter 78 which has a minimum stop band rejection of 40 decibels. Band stop filter 78, which is integrated into GPS antenna 24, isolates the transmitted telemetry signal from the received GPS signal. There is a need for band stop filter 78 because of the close proximity of antenna 22 to antenna 24, i.e. the antenna elements 32 and 34 of antenna 22 are separated from the antenna elements 60 and 62 of antenna 24 by approximately 9/16 of an inch. Without filter 78 coupling between antennas 22 and 24 would occur and the high power telemetry transmitting signal would interfere with receiving the low power GPS signal.

Filter 78 has two open circuit lines 80 and 82 and an interconnecting line 84 to form a three section band stop filter which impedes the telemetry transmitted signal from being received by the GPS receiving antenna 24. The band stop filter 78 parameters are approximately configured as two quarter-wavelength open-circuit lines separated by a quarter-wavelength at 2.25 GHz. The open circuit line 82 at feed point 72 consist of two parallel lines/stubs 82A and 82B.

Figure 4:
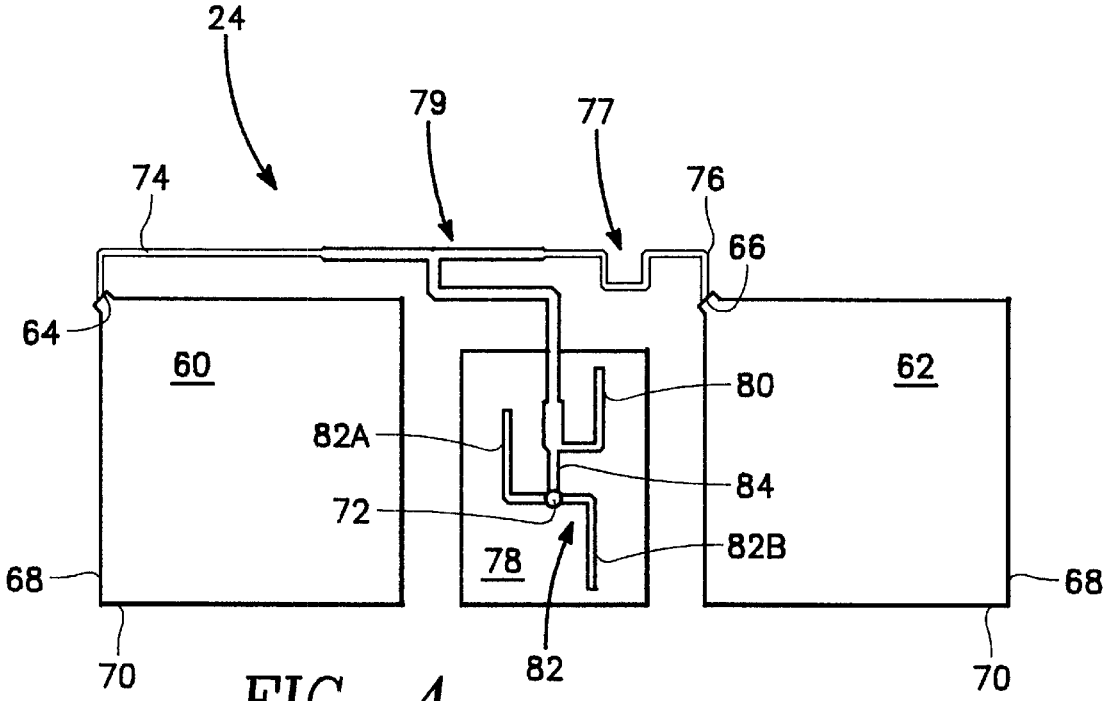
FIG. 4 is a schematic diagram illustrating the GPS antenna of FIG. 1.

Locating the two lines 82A.and 82B as shown in FIG. 4, reduces surface wave coupling by canceling the signal picked by one line 82A or 82B with the signal picked by the other line 82A or 82B. The lines 82A and 82B are physically located on dielectric substrate 24 such that the lines 82A and 82B are approximately 180 degrees out of phase with a surface wave that is transmitted by the telemetry antenna 22. For the frequency range of 1.565 to 1.585 GHz, GPS antenna 24 provides for a maximum 2:1 Voltage Standing Wave Ratio (9.5 DB return loss) input, equal magnitude to each element, and 0 degree phase difference. For the frequency range of 2.230 to 2.270 GHz, the insertion loss is greater.than 50 dB.

Figure 5:
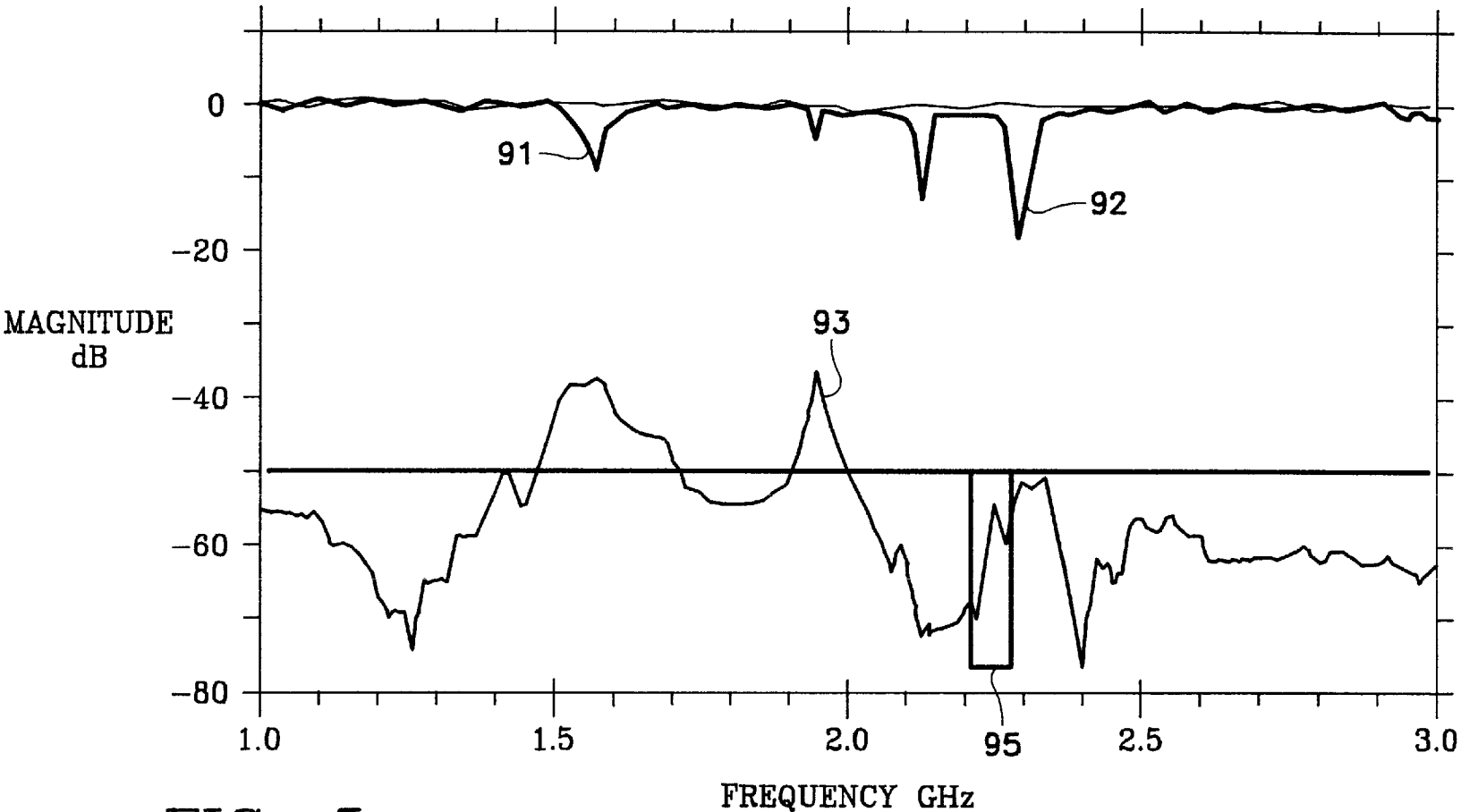
FIG. 5 illustrates the return loss and isolation between the telemetry antenna and the GPS antenna of FIG. 1.

Referring to FIG. 5, the return loss 91 of the GPS antenna and the return loss 92 of the telemetry antenna are acceptable. The isolation 93 between antennas was also acceptable with 50 dB isolation requirement being easily met. Reference numeral 95 depicts the band stop for filter 78.

Figure 6A:
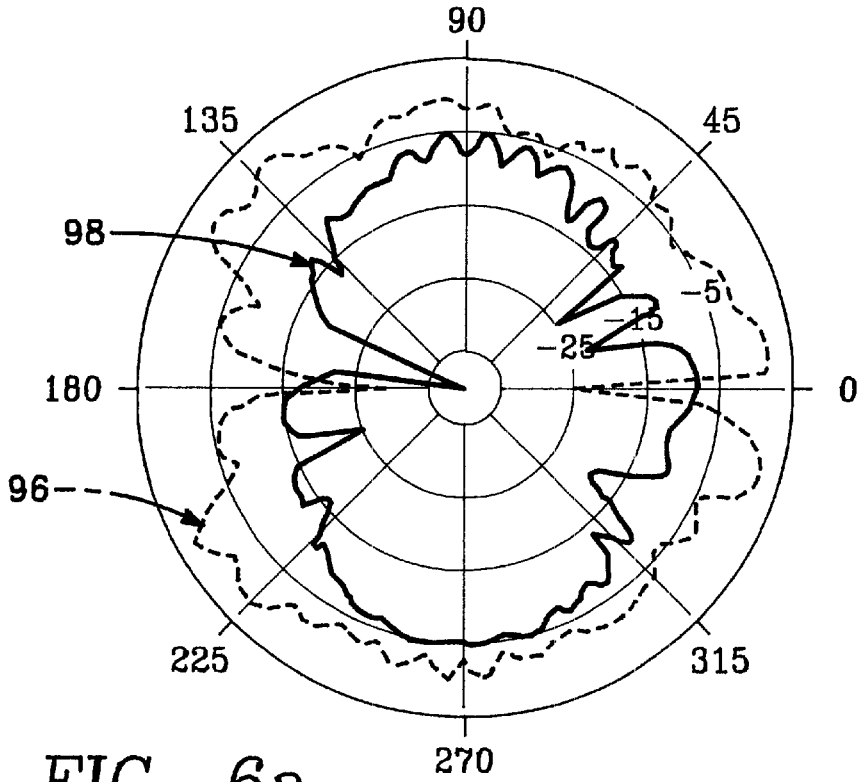
FIGS. 6*a* and 6*b* illustrate the antenna radiation Pitch patterns for the telemetry antenna and the GPS antenna of FIG. 1.
Figure 6B:
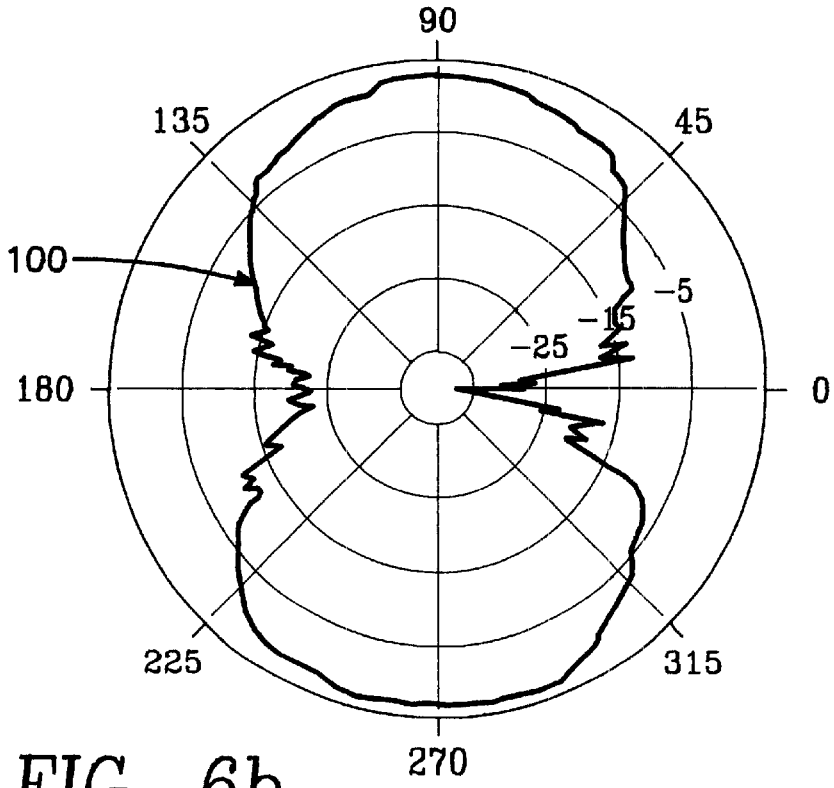
Figure 7A:
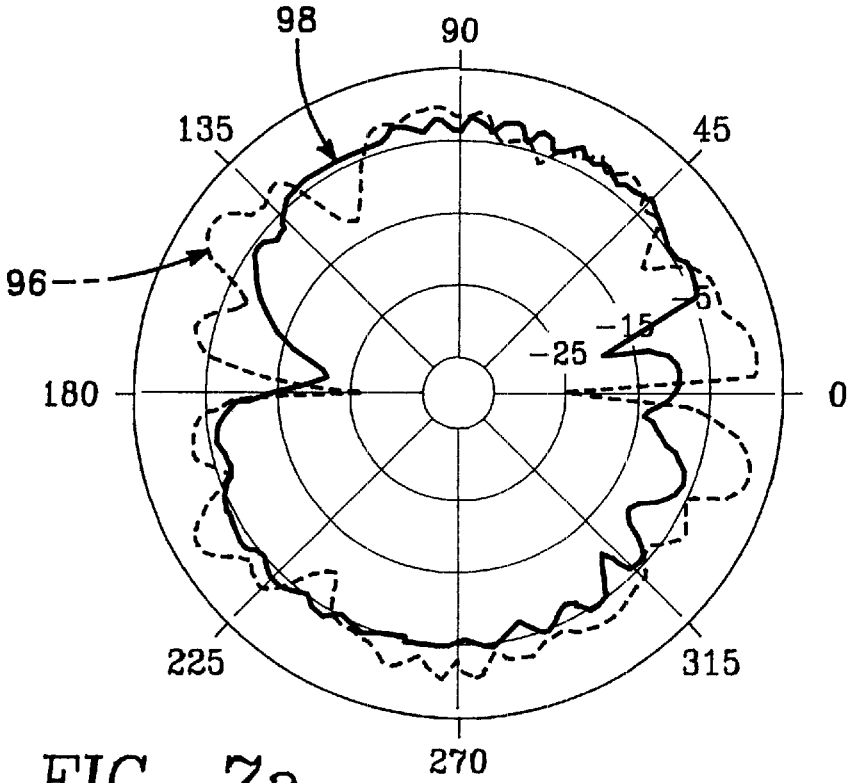
FIGS. 7*a* and 7*b* illustrate the antenna radiation Roll patterns for the telemetry antenna and the GPS antenna of FIG. 1.
Figure 7B:
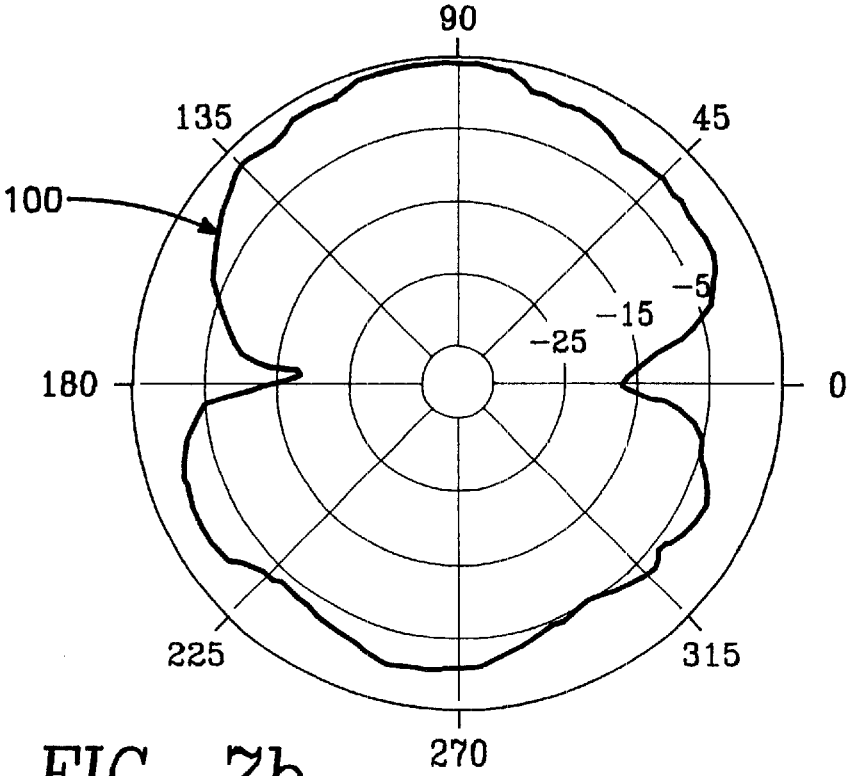
Figure 8A:
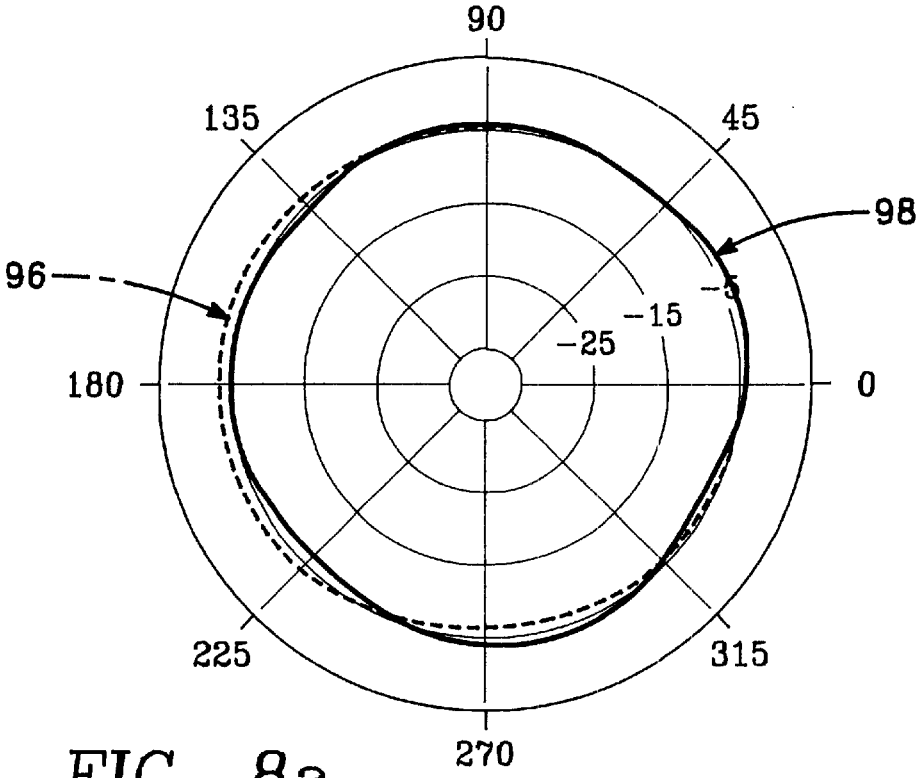
FIGS. 8*a* and 8*b* illustrate the antenna radiation Yaw patterns for the telemetry antenna and the GPS antenna of FIG. 2.
Figure 8B:
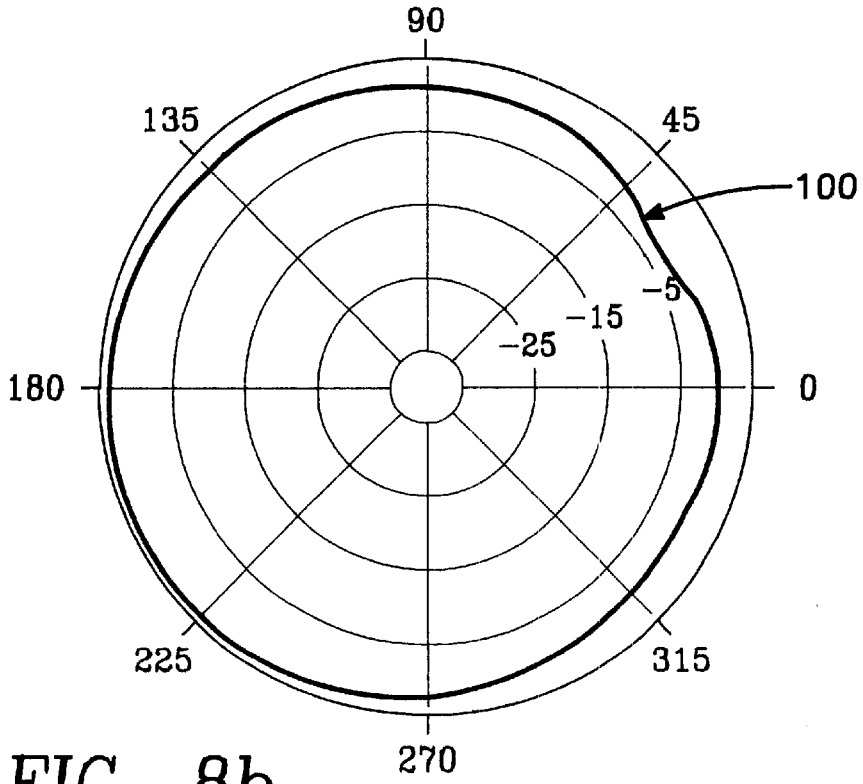

Referring. to FIGS. 6*a*, 6*b*, 7*a*, 7*b*, 8*a* and 8*b*, there is shown the antenna radiation pattern plane cut (Pitch, Yaw and Roll) measurements of both the GPS antenna (FIGS. 6*a*, 7*a* and 8*a*) and the telemetry.antenna (FIGS. 6*b*, 7*b* and 8*b*). The Pitch pattern (FIGS. 6*a* and 6*b*) and the Yaw pattern (FIGS. 7*a* and 7*b*) show a null at the nose and tail which was expected with a fairly small gain pattern variation over the rest of the azimuth. The Roll pattern (FIGS. 8*a* and 8*b*) show the variation due to only two elements around the outer circumference of projectile 26 to be an acceptable and within the 6 to 8 dB maximum specification. In general, all patterns show the gain to be above −10 dBLI for all coverage except at the nose and tail.

In FIGS. 6*a*, 7*a* and 8*a*, reference numeral 96 depicts horizontal polarization and reference numeral 98 depicts vertical polarization. In FIGS. 6*b*, 7*b* and 8*b* reference numeral 100 depicts vertical polarization.

At this time it should be noted that the antenna elements of antenna system 20 including telemetry antenna 22 and a GPS (Global Positioning System) antenna 24 as well as band stop filter 78 are fabricated from etched copper.

From the foregoing, it is readily apparent that the present invention comprises a new, unique, and exceedingly microstrip antenna for use on a small diameter projectile, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microstrip antenna system for use on a small diameter projectile comprising:

a ground plane mounted on an outer circumference of said small diameter projectile;

a dielectric substrate mounted on said ground plane;

a microstrip telemetry antenna spaced apart from and electrically separated from said ground plane by said dielectric substrate, said microstrip telemetry antenna transmitting a first RF signal;

a microstrip GPS (Global Positioning System) antenna mounted on said dielectric substrate in proximity to said microstrip telemetry antenna, said microstrip GPS antenna spaced apart from and electrically separated from said ground plane by said dielectric substrate, said microstrip GPS antenna receiving a second RF signal; and a band stop filter integrally formed with said microstrip GPS antenna on said dielectric substrate, said band stop filter providing for a minimum stop-band rejection of approximately 40 decibels to isolate the first RF signal transmitted by said microstrip telemetry antenna from the second RF signal received by said microstrip GPS antenna.

2. The microstrip antenna system of claim 1 wherein said first RF signal is an S-Band Radio Frequency signal having a center frequency of 2250 MHz.

3. The microstrip antenna system of claim 2 wherein said first RF signal has a bandwidth of ±10 MHz, said first RF signal having a linear polarization.

4. The microstrip antenna system of claim 1 wherein said second RF signal is an L-Band Radio Frequency signal having a center frequency of 1572.5 MHz.

5. The microstrip antenna system of claim 4 wherein said second RF signal has a bandwidth of ±10 MHz, said second RF signal having a circular polarization.

6. The microstrip antenna system of claim 1 wherein said microstrip telemetry antenna comprises:

a single feed input point;

a first antenna transmitting element positioned on one side of said projectile, said first antenna transmitting element having a rectangular shape and a notch feed point;

a second antenna transmitting element positioned on an opposite side of said projectile, said second antenna transmitting element having a rectangular shape and a notch feed point;

a first feed line having one end connected to the notch feed point of said first antenna transmitting element and an opposite end connected to said single feed input point;

a second feed line having one end connected to the notch feed point of said second antenna transmitting element and an opposite end connected to said single feed input point;

said second feed line including a plurality of right angle bends which lengthen said second feed line allowing said second feed line to provide for a 180 degree phase shift of said first RF signal when transmitted by said second antenna transmitting element, the 180 degree phase shift of said first RF signal insuring that an electric field for said first RF signal is continuous around the outer circumference of said projectile.

7. The microstrip antenna system of claim 1 wherein said microstrip GPS antenna comprises:

a first antenna receiving element positioned on one side of said projectile, said first antenna receiving element having a rectangular shape approximating a square and a corner feed point;

a second antenna receiving element positioned on an opposite side of said projectile, said second antenna receiving element having a rectangular shape approximating a square and a corner feed point;

a first feed line consisting of a quarter wavelength impedance transformer, said first feed line having one end connected to the corner feed point of said first antenna receiving element and an opposite end;

a second feed line consisting of a quarter wavelength impedance transformer, said second feed line having one end connected to the corner feed point of said second antenna receiving element and an opposite end; and a generally T shaped microstrip transmission line which connects said band stop filter to the opposite end of said first feed line and the opposite end of said second feed line.

8. The microstrip-antenna system of claim 1 wherein said band stop filter comprises a common feed point, first and second open circuit lines and an interconnecting line which connects said common feed point with said first and second open circuit lines to form a three section band stop filter.

9. The microstrip antenna system of claim 1 wherein said microstrip telemetry antenna is fabricated from etched copper.

10. The microstrip antenna system of claim 1 wherein said said microstrip GPS antenna and said band stop filter are fabricated from etched copper.

11. A microstrip antenna system for use on a small diameter projectile comprising:

a ground plane mounted on an outer circumference of said small diameter projectile;

a dielectric substrate mounted on said ground plane;

a microstrip telemetry antenna spaced apart from and electrically separated from said ground plane by said dielectric substrate, said microstrip telemetry antenna transmitting an S-Band Radio Frequency signal having a center frequency of 2250 MHz, a bandwidth of ±10 MHz, and a linear polarization;

a microstrip GPS (Global Positioning System) antenna mounted on said dielectric substrate in proximity to said microstrip telemetry antenna, said microstrip GPS antenna spaced apart from and electrically separated from said ground plane by said dielectric substrate, said microstrip GPS antenna receiving an L-Band Radio Frequency signal having a center frequency of 1572.5 MHz, a bandwidth of ±10 MHz, and circular polarization; and a band stop filter integrally formed with said microstrip GPS antenna on said dielectric substrate, said band stop filter providing for a minimum stop-band rejection of approximately 40 decibels to isolate the S-Band Radio Frequency signal transmitted by said microstrip telemetry antenna from the second L-Band Radio Frequency signal received by said microstrip GPS antenna.

12. The microstrip antenna system of claim 11 wherein said microstrip telemetry antenna comprises:

a single feed input point;

a first antenna transmitting element positioned on one side of said projectile, said first-antenna transmitting element having a-rectangular shape and a notch feed point;

a second antenna transmitting element positioned on an opposite side of said projectile, said second antenna transmitting element having a rectangular shape and a notch feed point;

a first feed line having one end connected to the notch feed point of said first antenna transmitting element and an opposite end connected to said single feed input point;

a second feed line having one end connected to the notch feed point of said second antenna transmitting element and an opposite end connected to said single feed input point;

said second feed line including a plurality of right angle bends which lengthen said second feed line allowing said second feed line to provide for a 180 degree phase shift of said S-Band Radio Frequency signal when transmitted by said second antenna transmitting element, the 180 degree phase shift of said S-Band Radio Frequency signal insuring that an electric field for said S-Band Radio Frequency signal is continuous around the outer circumference of said projectile.

13. The microstrip antenna system of claim 11 wherein said microstrip GPS antenna comprises:

a first antenna receiving element positioned on one side of said projectile, said first antenna receiving element having a rectangular shape approximating a square and a corner feed point;

a second antenna receiving element positioned on an opposite side of said projectile, said second antenna receiving element having a rectangular shape approximating a square and a corner feed point;

a first feed line consisting of a quarter wavelength impedance transformer, said first feed line having one end connected to the corner feed point of said first antenna receiving element and an opposite end;

a second feed line consisting of a quarter wavelength impedance transformer, said second feed line having one end connected to the corner feed point of said second antenna receiving element and an opposite end; and a generally T shaped microstrip transmission line which connects said band stop filter to the opposite end of said first feed line and the opposite end of said second feed line.

14. The microstrip antenna system of claim 11 wherein said band stop filter comprises a common feed point, first and second open circuit lines and an interconnecting line which connects said common feed point with said first and second open circuit lines to form a three section band stop filter.

15. The microstrip antenna system of claim 11 wherein said microstrip telemetry antenna, said microstrip GPS antenna and said band stop filter are fabricated from etched copper.

16. A microstrip antenna system for use on a small diameter projectile comprising:

a ground plane mounted on an outer circumference of said small diameter projectile;

a dielectric substrate mounted on said ground plane;

a microstrip telemetry antenna spaced apart from and electrically separated from said ground plane by said dielectric substrate, said microstrip telemetry antenna transmitting a S-Band Radio Frequency signal;

a microstrip GPS (Global Positioning System) antenna mounted on said dielectric substrate in proximity to said microstrip telemetry antenna, said microstrip GPS antenna spaced apart from and electrically separated from said ground plane by said dielectric substrate, said microstrip GPS antenna receiving an L-Band Radio Frequency signal; and a band stop filter integrally formed with said microstrip GPS antenna on said dielectric substrate, said band stop filter providing for a minimum stop-band rejection of approximately 40 decibels to isolate the S-Band Radio Frequency signal transmitted by said microstrip telemetry antenna from the L Band Radio Frequency signal received by said microstrip GPS antenna;

said band stop filter including a common feed point, first and second open circuit lines and an interconnecting line which connects said common feed point with said first and second open circuit lines to form a three section band stop filter, said interconnecting line connecting said common feed point to said microstrip GPS antenna; and said band stop filter, said microstrip GPS antenna and said microstrip telemetry antenna each being fabricated from etched copper.

17. The microstrip antenna system of claim 16 wherein said microstrip telemetry antenna comprises:

a single feed input point;

a first antenna transmitting element positioned on one side of said projectile, said first antenna transmitting element having a rectangular shape and a notch feed point;

a second antenna transmitting element positioned on an opposite side of said projectile, said second antenna transmitting element having a rectangular shape and a notch feed point;

a first feed line having one end connected to the notch feed point of said first antenna transmitting element and an opposite end connected to said single feed input point;

a second feed line having one end connected to the notch feed point of said second antenna transmitting element and an opposite end connected to said single feed input point;

said second feed line including a plurality of right angle bends which lengthen said second feed line allowing said second feed line to provide for a 180 degree phase shift of said S-Band Radio Frequency signal when transmitted by said second antenna transmitting element, the 180 degree phase shift of said S-Band Radio Frequency signal insuring that an electric field for said S-Band Radio Frequency signal is continuous around the outer circumference of said projectile.

18. The microstrip antenna system of claim 16 wherein said microstrip GPS antenna comprises:

a first antenna receiving element positioned on one side of said projectile, said first antenna receiving element having a rectangular shape approximating a square and a corner feed point;

a second antenna receiving element positioned on an opposite side of said projectile, said second antenna receiving element having a rectangular shape approximating a square and a corner feed point;

a first feed line consisting of a quarter wavelength impedance transformer, said first feed line having one end connected to the corner feed point of said first antenna receiving element and an opposite end;

a second feed line consisting of a quarter wavelength impedance transformer, said second feed line having one end connected to the corner feed point of said second antenna receiving element and an opposite end; and a generally T shaped microstrip transmission line which connects said band stop filter to the opposite end of said first feed line and the opposite end of said second feed line.

19. The microstrip antenna system of claim 16 wherein said S-Band Radio Frequency signal has a center frequency of 2250 MHz, a bandwidth of ±10 MHz and a linear polarization.

20. The microstrip antenna system of claim 16 wherein said L-Band Radio Frequency. signal has a center frequency of 1572.5 MHz, a bandwidth of ±10 MHz and a circular polarization.

* * * * *